US006446972B1

(12) United States Patent
Brunelle

(10) Patent No.: US 6,446,972 B1
(45) **Date of Patent: *Sep. 10, 2002**

(54) CASINO CARD GAME WITH BONUS HAND

(76) Inventor: Kenneth J. Brunelle, P.O. Box 671209, Dallas, TX (US) 75367

( * ) Notice: Subject to any disclaimer, the term of this patent is extended or adjusted under 35 U.S.C. 154(b) by 0 days.

This patent is subject to a terminal disclaimer.

(21) Appl. No.: 09/713,641

(22) Filed: Nov. 15, 2000

Related U.S. Application Data

(60) Continuation-in-part of application No. 09/514,856, filed on Feb. 28, 2000, now Pat. No. 6,189,888, which is a continuation of application No. 09/062,029, filed on Apr. 17, 1998, now Pat. No. 6,029,976, which is a division of application No. 08/942,846, filed on Oct. 2, 1997, now Pat. No. 5,820,128.

(51) Int. Cl.[7] ..... A63F 1/00

(52) U.S. Cl. ..... 273/292; 273/306; 273/274; 273/309

(58) Field of Search ..... 273/292, 306, 273/309, 274

(56) References Cited

U.S. PATENT DOCUMENTS

| | | | | | |
|---|---|---|---|---|---|
| 5,288,081 | A | * | 2/1994 | Breeding | 273/274 |
| 5,380,012 | A | | 1/1995 | Jones et al. | 273/292 |
| 5,407,208 | A | * | 4/1995 | Keller et al. | 273/292 |
| 5,415,414 | A | | 5/1995 | Savage | 273/306 |
| 5,417,430 | A | | 5/1995 | Breeding | 273/292 |
| 5,437,462 | A | * | 8/1995 | Breeding | 273/274 |
| 5,529,309 | A | * | 6/1996 | Bartlett | 273/292 |
| 5,544,892 | A | | 8/1996 | Breeding | 273/292 |
| 5,597,162 | A | * | 1/1997 | Franklin | 273/292 |
| 5,605,333 | A | | 2/1997 | Field | 273/274 |
| 5,692,755 | A | * | 12/1997 | Gutierres | 273/292 |
| 5,697,614 | A | * | 12/1997 | Potter et al. | 273/292 |
| 5,718,431 | A | * | 2/1998 | Armstein | 273/292 |
| 5,720,484 | A | * | 2/1998 | Hsu | 273/292 |
| 5,725,215 | A | * | 3/1998 | Hesse | 273/292 |
| 5,820,128 | A | * | 10/1998 | Brunelle | 273/292 |
| 5,851,011 | A | * | 12/1998 | Lott | 273/292 |
| 5,865,437 | A | * | 2/1999 | Moore, Jr. | 273/292 |
| 5,882,009 | A | * | 3/1999 | Schaefer | 273/292 |
| 5,901,958 | A | * | 5/1999 | Andrews | 273/292 |
| 5,961,120 | A | * | 10/1999 | Tarasov et al. | 273/309 |
| 6,029,976 | A | * | 2/2000 | Brunelle | 273/309 |
| 6,189,888 | B1 | * | 2/2001 | Brunelle | 273/292 |

* cited by examiner

*Primary Examiner*—Benjamin H. Layno
*Assistant Examiner*—Dolores R. Collins
(74) *Attorney, Agent, or Firm*—Dennis T. Griggs

(57) ABSTRACT

A wagering card game is played with a standard fifty-two card poker deck and a count limit card that is permanently assigned as the third card of the dealer's hand. Each player makes a bet. Three cards are dealt face down to each player, to the dealer and to the bonus hand. The players inspect their cards and have the option of trading one card. The dealer burns his top card and reveals his first two cards. The dealer's third card is a count limit card or the representation of a count limit card having a predetermined count value (for example 3) that is imprinted on the count limit card or on the playing surface, and is displayed at all times. The dealer combines his dealt cards with his count limit card and states his total. He then turns over each player's cards one at a time, compares each player's hand with the dealer's hand, determines whether the player is a loser or winner, pays or collects on the winner's and loser's hands, respectively. Any player who placed a bonus ante having a total less than or equal to a predetermined bonus count value (for example 9) is eligible for the bonus hand. The dealer turns over the bonus hand cards and announces the bonus hand total. He then refers to a bonus payout table and pays according to the payout value which matches with the player hand total and the bonus hand total.

30 Claims, 3 Drawing Sheets

CASINO CARD GAME WITH BONUS HAND

This application is a continuation in part of Ser. No. 09/514,856 filed Feb. 28, 2000 now U.S. Pat. No. 6,189,888, which is a continuation of Ser. No. 09/062,029 filed Apr. 17, 1998 now U.S. Pat. No. 6,029,976, which is a division of Ser. No. 08/942,846 filed Oct. 2, 1997 now U.S. Pat. No. 5,820,128.

BACKGROUND OF THE INVENTION

Casino gambling involves many different games of chance. Some casino games involve playing cards that are used in competition with the casino or against other players. In the most popular casino games, players compete against the casino, the games are fast-paced, provide more than one opportunity to win and the bets are resolved quickly. Generally, the shorter the time between placing a bet and the winning of a hand, the more popular the game.

Some casino card games are variations on poker, blackjack or baccarat in which winning hands are determined according to generally accepted rules of card value and rank. In baccarat and blackjack, the face cards are assigned numerical values. In blackjack, the object is to beat the dealer by scoring more than the dealer, but no more than twenty one. Additionally, blackjack may produce more than one winning hand during a round of play. Baccarat is a scoring game wherein the players play against each other in an effort to score as close to nine as possible. In poker, various combinations of cards determine the winner of each round and there is only one winning hand in each round of play.

Popular casino games based on the strategy and card priority of poker provide multiple opportunities to win. Caribbean Stud, a five-card poker game currently played in casinos, provides more than one chance to win with a particular hand. A limitation on the play of Caribbean Stud is the requirement for the dealer to have a qualifying hand, e.g., Ace-King. A player's hand may be a winner, but the player may lose the opportunity to receive a large payout because the dealer did not receive a qualifying hand.

Another popular casino game comparable to Caribbean Stud is Let It Ride, a game based on poker strategy and card priority. In the play of Let It Ride, as described in U.S. Pat. No. 5,437,462, three cards are dealt to the player and two to the dealer. The player then combines his cards with the dealer's cards to produce a poker hand. Let It Ride is popular because of its fast-paced play, simple strategies, the opportunity to participate in an additional jackpot and multiple opportunities to win in the same hand.

A limitation on the play of Let It Ride is the apparent complexity of the betting. Three bets are placed on each hand with two of the bets being resolved, or withdrawn by the player, during three stages of play. A fourth bet is a bonus jackpot bet and is forfeited if the player does not receive a bonus hand. A prospective player must overcome his reluctance to wager three times on one hand to begin play. The option to withdraw a portion of the wager is not productive for the casino—the player is allowed to take back a portion of the bet that has already been committed.

The highest ranked poker hand is a winner for both Caribbean Stud and Let It Ride. Based on the method of betting, both games allow multiple opportunities to win and generally meet the requirements for a popular casino game. However, the dealer-qualifying requirement of Caribbean Stud and the complexities of the betting requirements of Let It Ride are discouraging to the average player.

Other wagering card game methods are known. For example in Padukee, as described in U.S. Pat. No. 5,415,414, the player places two bets plus a bonus jackpot wager.

BRIEF SUMMARY OF THE INVENTION

The wagering card game of the present invention is played with a deck of fifty-two playing cards, preferably a poker deck, and a count limit card or a representation of a count limit card having a predetermined count value N, where N is a whole number, for example 3. Preferably, the wagering card game of the present invention is played with cards drawn one at a time from a shoe containing six poker decks. Each playing card is assigned a count value with the numbered cards having the corresponding whole number values 2 through 10, respectively; the face cards (King, Queen, Jack) each having an assigned count value of ten; and each Ace having an assigned count value of one. Only one count limit card or representation thereof is utilized and it is permanently assigned as the third card of the dealer's hand.

Each player wagers a minimum amount by posting his total bet in a wager circle provided on a playing surface. Each player may then pay an ante stake for the right to participate in a bonus payout. The dealer deals three cards, face down, to all the players, the dealer and to the bonus hand card dock. Each player picks up his cards and evaluates them for further play.

Each player then has the following options: (1) if the player is satisfied with the three cards dealt to him he places them next to his bet; or, (2) if the player is not satisfied with the cards he was dealt he may trade one of his cards for a new card. The dealer, from left to right, one player at a time, will burn the trade card and deal a replacement card to each trade option player. After evaluating his new hand, each player will place his cards next to his bet. All players now have three cards, face down, next to their bets.

The dealer then burns his top (last dealt) card and reveals his other two dealt cards. The dealer has a numerical count value N permanently assigned as the third card of his hand by a count limit card (not taken from the game deck) or by the representation of a count limit card that is positioned or imprinted on the playing surface in the dealer's third card dock. For example, the number "3" (imprinted onto the playing surface) replaces the dealer's burned card.

The dealer combines the count of his two retained cards with the count of his assigned count limit card and announces his total score. The dealer then reveals all three cards of each player, one player at a time, totals the count of each hand and determines the winning hands. All winners are paid even money except three aces which pays 30 to 1.

To qualify for the bonus hand, a player must post a bonus ante stake (for example, $1) and have a three card total less than or equal to a predetermined count value M, where M is a whole number, for example 9. Each player whose hand totals 9 or lower and who wage red the bonus ante stake is eligible to play the bonus hand at the end of the round. A player need not have a winning hand to qualify for the bonus hand. The bonus hand is a community hand and the right to participate in the bonus payout is not contingent on winning the round.

At this time, the dealer turns over the bonus hand and announces the total. The dealer pays the qualifying players the bonus amount according to a predetermined bonus payout schedule, for example the Table II One Dollar Bonus Ante Payout Table. The bonus pay-out schedule is a matrix array or table of bonus payout values corresponding with bonus hand totals arranged along one axis and the player's hand totals arranged along the other axis. As shown in Table II, a particular bonus payout value is located in the box corresponding with a particular bonus hand total and a particular player's hand total.

DETAILED DESCRIPTION OF THE INVENTION

Figure 1:
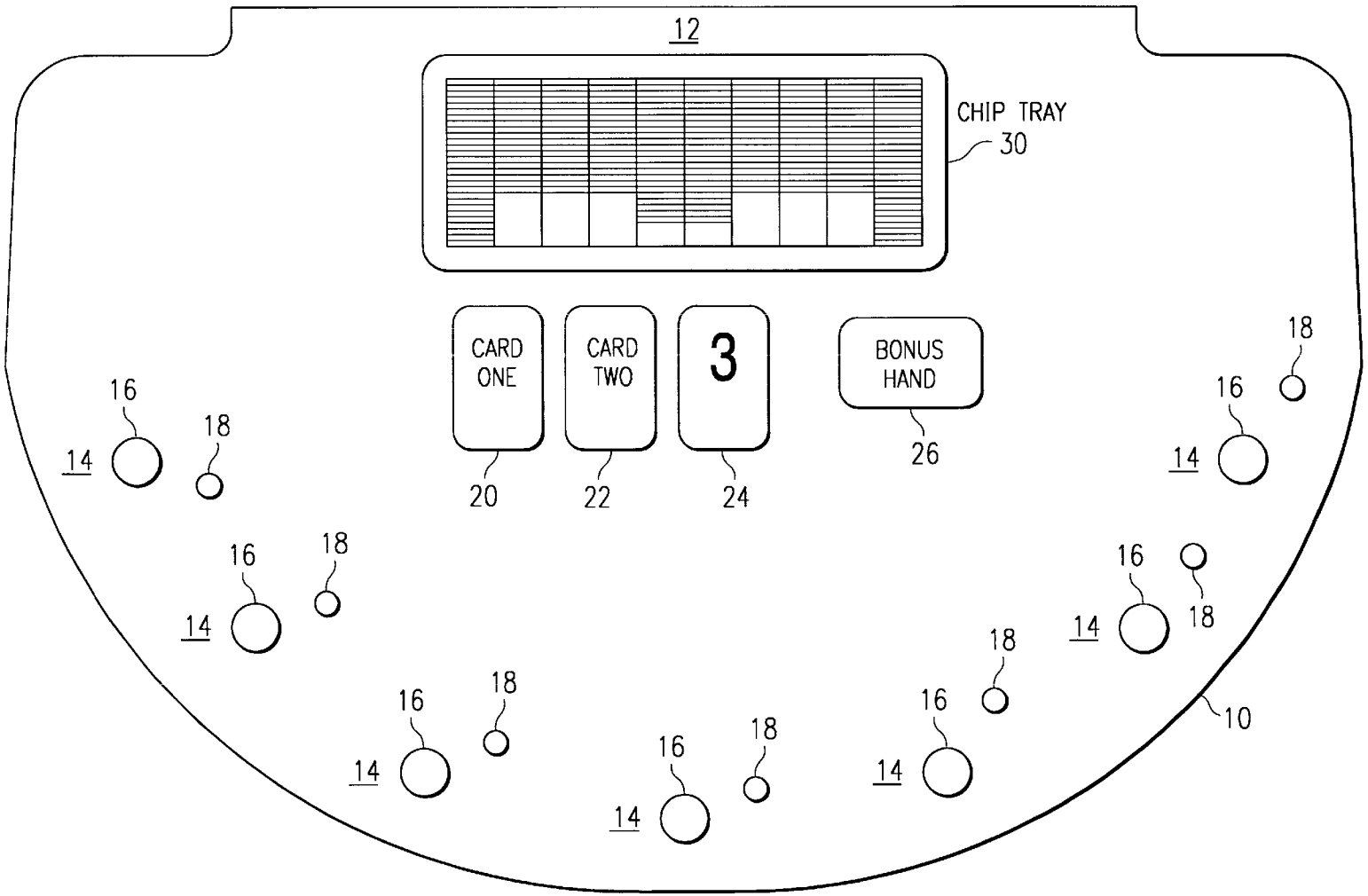
FIG. 1 illustrates the table layout of a playing surface used in the wagering game of the present invention.

Referring to FIG. 1, the wagering game of the present invention referred to herein as "Aces Low," is a low card game played on a real or simulated playing surface 10. The playing surface is preferably a preprinted felt covering that is placed on top of a gambling table. Alternatively, the playing surface can be simulated on a video screen and the game can be played via computer under software control with the cards being simulated and the player participating via an interactive video station. Depicted on the playing surface 10 is a single dealer position 12 and multiple player positions 14. The layout of each player position 14 is identical to all other player positions. Although seven player positions 14 are shown, as many as ten players or as few as one player and one dealer may play the game. Each player position 14 includes a betting circle 16 for receiving the player's wager and an optional bonus ante circle 18.

Figure 3:
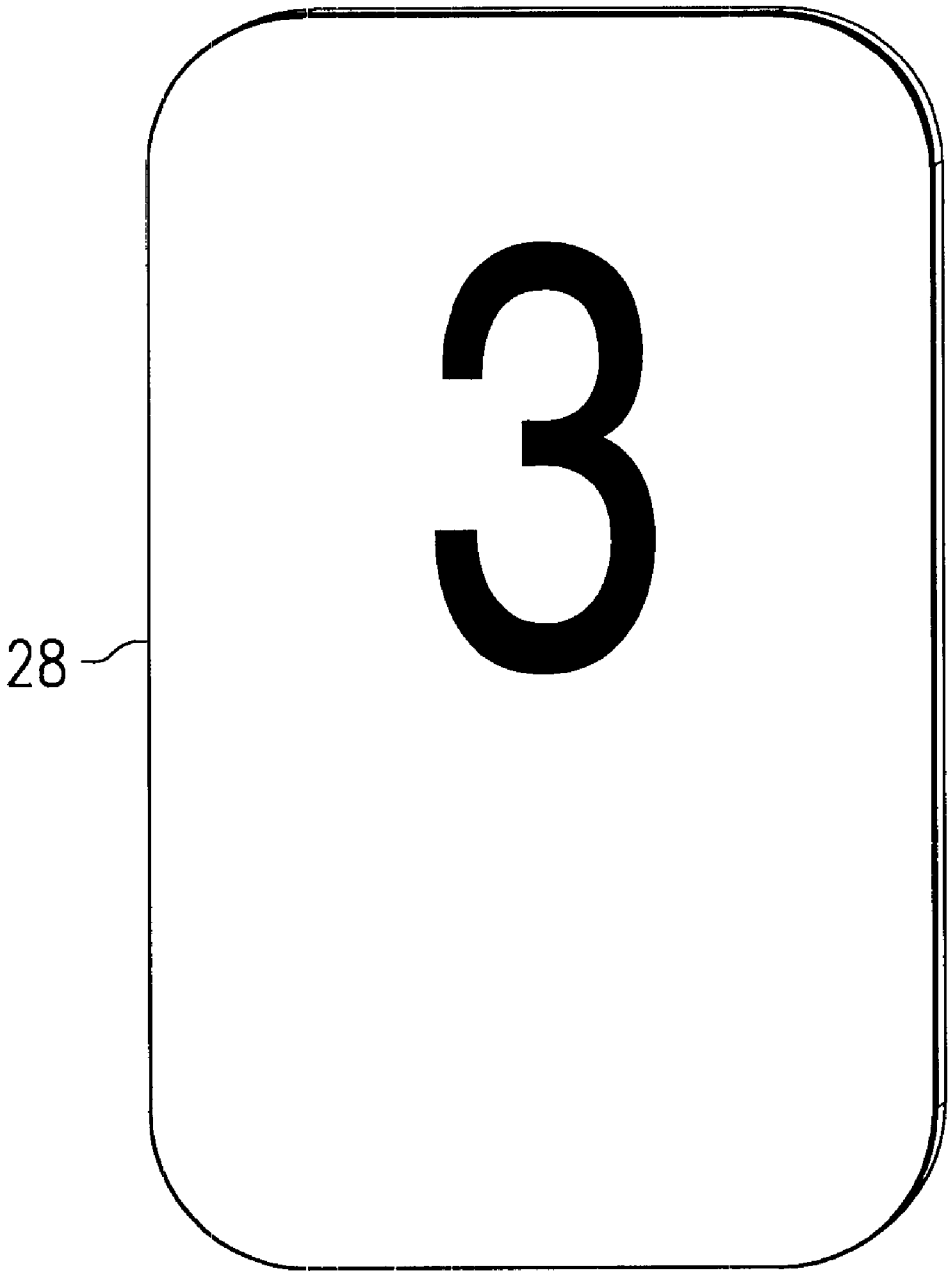
FIG. 3 is a perspective view of count limit card imprinted with a non-suited whole number that is permanently assigned as the third card of the dealer's hand.

Referring again to FIG. 1, the dealer position 12 includes two card docks 20 and 22, labeled CARD ONE and CARD TWO, a third card dock 24 and a bonus hand card dock 26. Preferably, a predetermined numerical count value N, for example the non-suited whole number 3, is imprinted on the playing surface 10 inside the dealer's third card dock 24 and thus serves as the permanent third card of the dealer's hand. According to an alternative embodiment as shown in FIG. 3, a non-suited count limit card 28 (not taken from the game deck) having a numerical count value N, for example the whole number 3, is placed inside the third card dock 24 and is permanently assigned as the third card of the dealer's hand. A rectangular area 30 is designated for the dealer's chip tray.

The bonus hand card dock 26 is large enough to accommodate three standard size poker cards. A bonus hand is an extra hand of cards (equal in number to the number of cards dealt to each player) that is not dealt to any particular player or to the dealer. The total count value of the bonus hand is used to determine a bonus ante payout to each bonus-qualified player, as determined by reference to a set of bonus payout values as shown in Table II.

Figure 2:
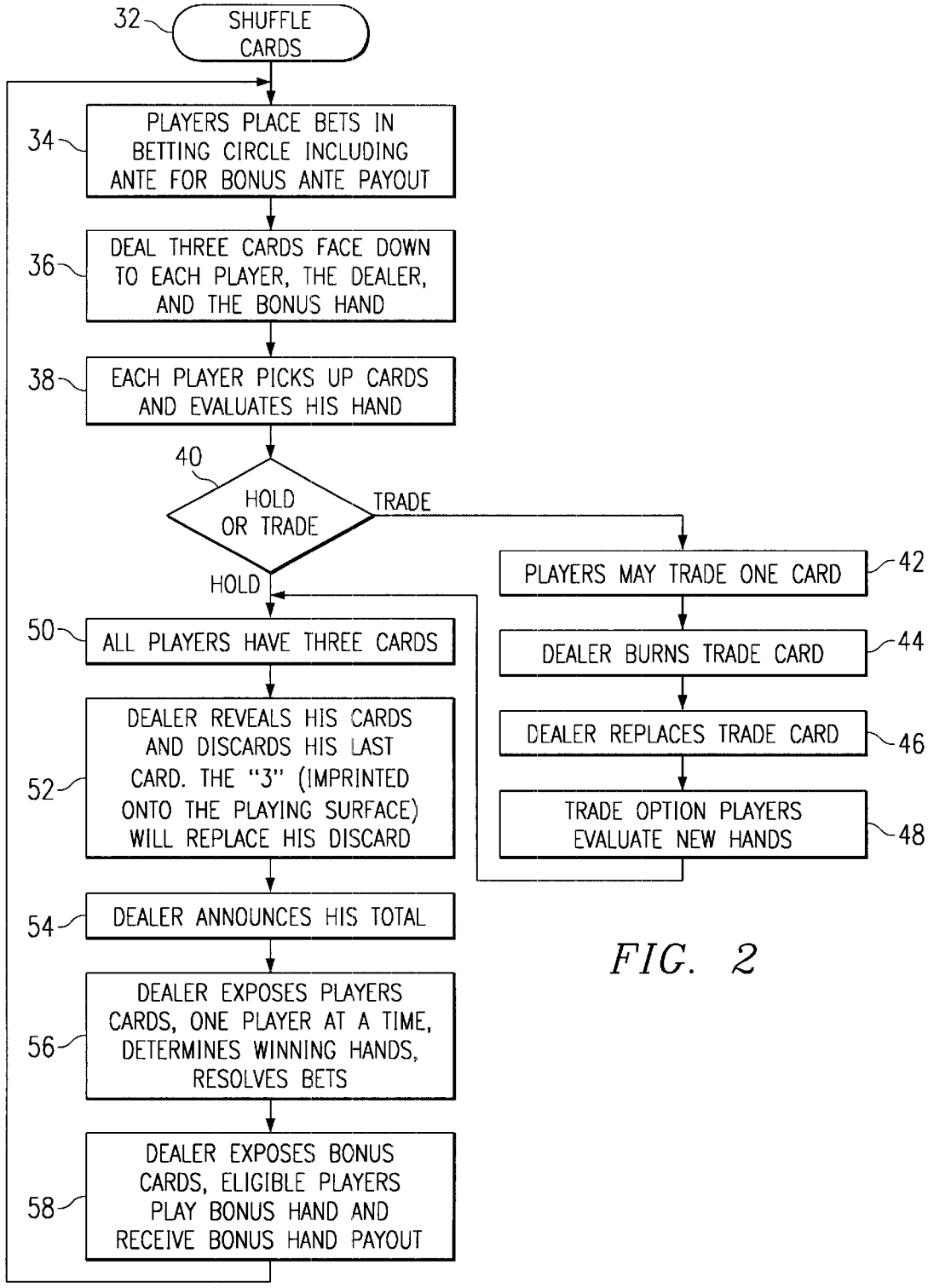
FIG. 2 is a block diagram representing the flow of play in the game.

Referring to the flow diagram in FIG. 2, a standard poker deck of fifty-two cards is shuffled at block 32. The deck may be shuffled manually by the dealer, by an automatic shuffling machine or by computer. Preferably, the cards are dealt from a standard casino shoe containing six standard poker decks. Each deck contains fifty-two cards, so that fresh cards are immediately available for dealing from a new deck as each deck is exhausted. The players then place bets, block 34, wherein each player's total wager is posted into the betting circle 16. At this time, each player may pay a bonus ante stake, for example one dollar, for the right to participate in a bonus payout. Each player places his optional bonus ante in the bonus ante circle 18.

After the players have posted their bets, the dealer deals three cards face down to each player, to the dealer and to the bonus hand, block 36. The players pick up their cards and evaluate their hands, block 38. The dealer's cards and the bonus hand cards remain face down. At this point, each player decides whether to hold or trade, block 40. If a player decides to trade, he discards one of his cards (the trade card) face down, when prompted by the dealer, block 42. The dealer then burns the trade card, block 44. The dealer then deals a replacement card face down, block 46, and the trade option players evaluate their new hands, block 48.

At this point, all players have three cards, block 50. Each player places his cards face down adjacent to his bet in betting circle 16. The dealer burns his top (last dealt) card and turns over his two remaining cards, block 52. The dealer declares the total count of his hand, block 54, by combining the count values of his dealt cards in his first and second card docks with the count value N of his assigned third card, count limit card 28, or representation thereof in his third card dock 24, as shown in FIG. 3.

The numerical count value N of the dealer's count limit card is a whole number selected from the set of positive whole numbers {2, 3, 4, 5, 6}. In the preferred embodiment, the count limit value N=3. The count value N of the dealer's permanently assigned third card establishes the low count limit (2+N) and the high count limit (20+N) on the total count value of the dealer's hand. The selected value N also determines the odds of winning and losing.

The dealer then turns over each player's three cards, one at a time and determines winning hands, block 56. A winning hand is defined as any hand which has a total count value which is less than the total count value of the dealer's hand. At this time, the dealer resolves all table bets according to a regular pay-out schedule, on an even money (1-to-1) basis for all winning hands (except for a hand of three aces which pays 30-to-1). Players whose total is greater than that of the dealer will lose their bets and players whose total is equal to the dealer's total will "push."

Any player whose total hand is less than or equal to a predetermined count value M, where M is a whole number selected from the set of numbers {7, 8, 9, 10} and who wagered a bonus ante stake is eligible for the bonus hand. The count value M determines the odds of winning a bonus hand payout. Preferably, the count value M=9.

The dealer then turns over and reveals the three bonus cards, block 58, and totals the three bonus cards. The dealer resolves the bonus bets according to a bonus pay-out schedule, for example as shown in Table II. The bonus payout schedule is displayed for viewing by all players during the play of each round, for example on a printed placard set up adjacent the playing table, on an overhead video screen, or on a printed "How to Play" pocket-size card.

The bonus pay-out schedule is a matrix of bonus payout values corresponding with a set of bonus hand totals on one matrix axis and a set of player hand totals on the other axis. Preferably, the bonus payout schedule is a matrix composed of bonus hand values x arranged along a row or an x-axis, where x={3, 4, 5, 6, 7, 8, 9, 10, 11, 12, 13, 14, 15, 16, 17, 18, 19, 20, 21, 22, 23, 24, 25, 26, 27, 28, 29, 30}, and player hand values y arranged along a column or y-axis, where y={3,4,5,6,7,8,9}. A predetermined bonus payout value is indicated at each (x, y) coordinate which corresponds with a unique bonus hand total/player hand total.

It will be apparent that the card game of the present invention overcomes the limitations of conventional casino games such as Caribbean Stud and Let It Ride. "Aces Low" includes all the attributes desired for a popular wagering card game: it is simple to play and fast-paced; a player is able to win a bonus payout with the same hand; and the game provides for the possibility of multiple winners during the play of each hand.

For example, as shown in Table I, multiple winners include hand with the lowest score and a hand with a score lower than the dealer. All winning hands are paid during the same round of play according to a regular payout schedule, for example on a even-odds (1-to-1) basis except three aces which pays 30-to-1. The hands of the players who are eligible for a bonus hand and placed a bonus ante are resolved and paid at the same time according to a bonus ante payout schedule, for example as shown in Table II.

This new casino table game, referred to as Aces Low, is a fun and easy to learn three-card low game in which all players compete separately against the dealer as in blackjack. A shoe with six decks (as in blackjack) is used to play Aces Low. In the play of Aces Low, Aces count as one and Jacks, Queens and Kings each count as ten.

The player first places his bet in the betting circle. The minimum and maximum bets will be determined by the casino. An optional one dollar bonus side bet may be posted at this time.

After all bets are placed, the dealer deals three cards to all players, himself and to the bonus hand located to the left of the dealers hand. The three cards that make up the bonus hand are only used at the end of the round for players paying the one dollar bonus side bet and having a hand count total of 9 or less. The dealer will burn this top card (card three) and place the other two into position. The dealer's third card "the 3" is imprinted onto the playing surface and is permanent.

All players will now evaluate their three cards. If a player likes the hand he is dealt he simply puts his three cards, face down, next to his bet and waits until the end of the round. A player who does not like the hand he is dealt may trade one of his three cards for a new one. There is no cost to trade a card. The dealer from left to right, one player at a time, will burn the trade card and give the trade option player a replacement card. After evaluating his new hand the trade option player will place his cards, face down, next to his bet. All players now have three cards, face down, next to their bet.

At this time the dealer will turn over his two cards. To total the dealers hand the dealer will total the two cards along with his permanent 3 for a three card total. Each player's hand is totaled simply by adding up all three cards. Aces have a value of one and Jacks, Queens and Kings each have a value of ten. Suit values are not considered. Any player who has a lower total than the dealer wins and will be paid even money on his bet (except for players having three Aces-pays 30 to 1). In the event of a tie it is a push with no money exchanging hands. If the dealers's hand is lower than the player's hand the player loses his bet. From left to right, one player at a time, the dealer will turn over each player's three cards and determines the winner. At this time the dealer will pay or collect bets and burn the players' cards.

Only those players paying the one dollar side bet are eligible to play the bonus hand. Players playing the bonus hand need a total of 9 or under to play. At the end of the round, the dealer will turn over the bonus hand and announce the total. The bonus hand is a community hand. The one dollar cash payout values are displayed on the one dollar bonus payout table as shown in Table II. After all hands are resolved another round is immediately started.

The foregoing description of a preferred embodiment illustrates the best mode for playing the game of the present invention. The bonus payout values given herein are for explanation purposes only.

TABLE I

EXAMPLE HANDS

| Position | Original Hand | Trade Hand | Results | Bonus Hand |
|---|---|---|---|---|
| Dealer | Card one: 9<br>Card two: 4<br>Card three: 8 (burn top card)<br>Card three: 3 (permanently assigned) | No trade | Total is 16<br>Dealer receives no payout. | No bonus hand played. (Not allowed) |
| Player 1<br>Pays one dollar ante stake | Card one: 3<br>Card two: 4<br>Card three: 5 | No trade | Total is 12<br>Beats dealer<br>Pays 1 tirne the amount of original bet. | No bonus hand played |
| Player 2<br>pays one dollar ante stake | Card one: 4<br>Card two: 10<br>Card three: 10 (trade) | Card one: 4<br>Card two: 10<br>Card three: 10 | Total is 24<br>Pays nothing<br>Player loses bet | No bonus hand played |
| Player 3<br>pays one dollar ante stake | Card one: 5<br>Card two: 10 (trade)<br>Card three: 7 | Card one: 5<br>Card two: Ace<br>Card three: 7 | Total is 13<br>Beats dealer<br>Pays 1 time the amount of original bet | No bonus hand played |
| Player 4<br>pays one dollar ante stake | Card one: 6<br>Card two: 2<br>Card three: 9 (trade) | Card one: 6<br>Card two: 2<br>Card three: 8 | Total is 16<br>Pays nothing (push)<br>Player retains bet | No bonus hand played |
| Player 5 | Card one: Ace<br>Card two: 2 | No trade | Total is 5<br>Plays the bonus hand with winning total of 9 or lower | Card one: 10<br>Card two: 2<br>Card three: 10<br>Total is 22 |

TABLE I-continued

| EXAMPLE HANDS | | | | |
|---|---|---|---|---|
| Position | Original Hand | Trade Hand | Results | Bonus Hand |
| | Card three: 2 | | | Pays One Dollar (Free Ride) according to Table II. |

TABLE II

| BONUS ANTE PAYOUT SCHEDULE | | | | | | | | |
|---|---|---|---|---|---|---|---|---|
| ANTE $1 | Bonus Hand Total of 3 | Bonus Hand Total of 4 | Bonus Hand Total of 5 | Bonus Hand Total of 6 | Bonus Hand Total of 7 | Bonus Hand Total of 8–10 | Bonus Hand Total of 11–17 | Bonus Hand Total of 18–30 |
| Player's Total = 3 | $100,000 | $10,000 | $2,000 | $1,000 | $600 | $200 | $100 | $50 |
| Player's Total = 4 | $5,000 | $1,500 | $800 | $400 | $200 | $100 | $50 | $25 |
| Player's Total = 5 | $2,500 | $800 | $400 | $200 | $100 | $50 | $25 | $11 |
| Player's Total = 6 | $1,000 | $400 | $200 | $100 | $50 | $25 | $11 | $7 |
| Player's Total = 7 | $600 | $200 | $100 | $50 | $25 | $11 | $7 | $4 |
| Player's Total = 8 | $400 | $100 | $50 | $25 | $11 | $7 | $1 | $1 |
| Player's Total = 9 | $200 | $50 | $25 | $11 | $7 | $4 | $1 | $1 |

What is claimed is:

1. A method of playing a wagering card game between a dealer and one or more players comprising the following steps:

placing a wager to participate in the card game;

dealing a hand cards from a deck of cards to each player, the dealer and a bonus hand, respectively;

providing a bonus payout schedule comprising a set of bonus payout values, each payout value corresponding to the play of a particular player hand and a particular bonus hand;

resolving each player's bet based on at least two of:

(i) the value of each player's hand relative to the value of the dealer's hand;

(ii) the value of each player's hand relative to a predetermined count value; and, (iii) the bonus payout value as indicated by the bonus payout schedule.

2. A method of playing a wagering card game as set forth in claim 1, including the steps:

each player evaluating his hand to determine whether to trade or hold;

each player trading a card or holding his hand; and dealing a replacement card to each trade option player.

3. A method of playing a wagering card game as set forth in claim 1, including the step:

declaring a player's hand to be a winning hand if the total count value of the player's hand is less than the total count value of the dealer's hand.

4. A method of playing a wagering card game as set forth in claim 1, including the step:

declaring a player's hand to be a losing hand if the total count value of the player's hand is more than the total count value of the dealer's hand.

5. A method of playing a wagering card game as set forth in claim 1, including the step:

declaring a player's hand to be a push if the total count value of the player's hand is equal to the total count value of the dealer's hand.

6. A method of playing a wagering card game as set forth in claim 1, including the step:

declaring a player's hand to be qualified to participate in a bonus payout if the total count value of the player's hand is less than or equal to a number selected from the number set {7, 8, 9, 10}.

7. A method of playing a wagering card game as set forth in claim 1, including the step:

each player exercising or declining the option to post a bonus ante to be eligible to participate in a bonus payout.

8. A method of playing a wagering card game as set forth in claim 1, including the step:

selecting the predetermined count value from the number set {7, 8, 9, 10}.

9. A method of playing a wagering card game as set forth in claim 8, wherein the selected count value is the number 9.

10. A method of playing a wagering card game as set forth in claim 1, including the steps:

each player exercising or declining the option to post a bonus ante for the right to participate in the play of a bonus ante payout, and upon posting a bonus ante becoming a bonus-eligible player;

declaring a player's hand to be qualified to participate in a bonus payout if the total count value of the player's hand is less than or equal to a number selected from the number set {7, 8, 9, 10}; and paying a bonus to each bonus-eligible player holding a bonus-qualified hand according to a payout value selected from the bonus payout schedule.

11. A method of playing a wagering card game as set forth in claim 1, wherein the bonus payout values are indicated by cross-reference to the possible count values of the player hand and the possible count values of the bonus hand, and the possible player hand values are arranged in a column of numbers comprising the number set {3,4,5,6,7,8,9}; and the possible bonus hand values are arranged in a row of numbers comprising the number set {3,4,5,6,7,8–10, 11–17 and 18–30}.

12. A method of playing a wagering card game between a dealer and one or more players comprising the following steps:

placing a wager to participate in the card game;

dealing a hand of cards from a deck of cards to each player, the dealer and a bonus hand, respectively;

assigning a count limit card or a representation of a count limit card having a predetermined numerical count value to the dealer's hand; and resolving each player's bet based on at least two of:

(i) the total count value of each player's hand relative to the total count value of the dealer's hand;

(ii) the total count value of each player's hand relative to a predetermined count value; and (iii) a bonus payout value, as indicated by a bonus payout schedule, corresponding with the play of a predetermined player hand and a predetermined bonus hand.

13. A method of playing a wagering card game as set forth in claim 12, including the steps:

each player exercising or declining the option to pay a bonus ante for the right to participate in a bonus payout, and upon paying a bonus ante becoming a bonus-eligible player;

declaring a player's hand to be qualified to participate in a bonus payout if the total count value of the player's hand is less than or equal to a predetermined number; and paying a bonus to each bonus-eligible player holding a bonus-qualified hand according to a payout value selected from the bonus payout schedule.

14. A method of playing a wagering card game as set forth in claim 12, including the step:

selecting a bonus payout value from a matrix or table of bonus payout values corresponding to predetermined bonus hand values arranged along a first coordinate axis and predetermined player hand values arranged along a second coordinate axis.

15. A method of playing a wagering card game as set forth in claim 12, including the step of selecting a bonus ante payout value from a set of cross-referenced table values arranged to correspond with index rows and index columns wherein:

the player hand total values are arranged in an index column of numbers comprising the number set {3,4,5, 6,7,8,9}; and the bonus hand total values are arranged in an index row of numbers comprising the number set {3,4,5,6,7,8–10, 11–17 and 18–30}.

16. A method of playing a wagering card game as set forth in claim 12, including the step:

selecting the number 3 as the predetermined numerical value of the dealer's permanent count limit card or the representation thereof.

17. A method of playing a wagering card game as set forth in claim 12, including the step:

selecting the predetermined value of the count limit card or the representation thereof from the number set {3, 4, 5, 6}.

18. A method of playing a wagering card game as set forth in claim 12, including the step:

selecting a bonus payout value from a matrix of bonus payout values, each bonus payout value corresponding to a predetermined bonus hand value from a set of bonus hand values arranged along a first coordinate axis and a predetermine player hand value from a set of player hand values arranged along a second coordinate axis.

19. A wagering card game comprising, in combination:

a deck of playing cards;

a playing surface;

a count limit card or graphical representation thereof having a predetermined numerical count value;

multiple player stations disposed on the playing surface, each player station including a betting circle for placing bets;

a dealer station disposed on the playing surface, the dealer's station including first and second card docks for receiving and displaying first and second playing cards, respectively, and a third card dock for receiving and displaying the count limit card or graphical representation thereof;

a bonus card dock for receiving and displaying bonus cards; and a bonus payout table including a matrix of bonus payout values, the bonus payout values being arranged in rows and columns corresponding to predetermined count values of a player hand and predetermined count values of a bonus hand.

20. A wagering card game as set forth in claim 19, wherein the player's hand values are arranged in a column of numbers comprising the number set {3,4,5,6,7,8,9}; and the bonus hand values are arranged in a row of numbers comprising the number set {3,4,5,6,7,8–10, 11–17 and 18–30}.

21. A wagering card game as set forth in claim 19, wherein the count limit card comprises a non-suited playing card having a number corresponding with the numeral count value imprinted on one side thereof.

22. A wagering card game as set forth in claim 19, wherein the numerical value of the count limit card is a whole number selected from the number set {3, 4, 5, 6}.

23. A wagering card game comprising, in combination:

a deck of playing cards;

a playing surface;

multiple player stations disposed on the playing surface, each player's station including a betting circle for receiving a player's bet and a bonus ante circle for receiving a player's bonus ante wager;

a dealer station disposed on the playing surface, the dealer station including first and second card docks for receiving and displaying first and second playing cards, respectively, and a third card dock including a graphical representation of a non-suited playing card imprinted on the playing surface;

a bonus hand card dock disposed on the playing surface for receiving a hand of first, second and third playing cards; and a bonus payout schedule comprising a set of bonus payout values, each bonus payout value corresponding to the play of a predetermined player hand and a predetermined bonus hand.

24. Apparatus for playing a wagering card game between a dealer and one or more players comprising, in combination:

a deck of playing cards including a hand of first, second and third playing cards dealable from the deck to each player, a hand of first, second and third playing cards dealable from the deck to the dealer, and a hand of first, second and third playing cards dealable from the deck to the bonus hand, respectively;

a playing surface;

one or more player stations disposed on the playing surface, each player's station including a betting circle for receiving a player's bet;

a dealer station disposed on the playing surface, the dealer station including first and second card docks for receiving and displaying first and second playing cards, respectively, a third card dock and a count limit card or a representation thereof disposed on the playing surface within the third card dock;

a bonus hand card dock; and a bonus payout schedule including a set of bonus payout values, each payout value corresponding to the play of a predetermined player hand and a predetermined bonus hand.

25. A wagering card game as set forth in claim 24, wherein the count limit card is a non-suited playing card having a number corresponding with a numerical count value imprinted on one side thereof, the numerical count value being selected from the number set {3, 4, 5, 6}.

26. A wagering card game as set forth in claim 24, wherein the representation of the count limit card indicates a number selected from the number set {3, 4, 5, 6}.

27. Apparatus for playing a wagering card game between a dealer and one or more players comprising, in combination:

a deck of playing cards;

a hand of playing cards dealable from the deck to each player;

a hand of playing cards dealable from the deck to the dealer;

a hand of playing cards dealable from the deck to a bonus hand; and a bonus payout schedule including a set of bonus payout values, each payout value corresponding to the play of a predetermined player hand and a predetermined bonus hand.

28. Apparatus for playing a wagering card game as set forth in claim 27, including a count limit card, not taken from the deck, the count limit card being assigned as one playing card of the dealer's hand and having a predetermined numerical count value.

29. Apparatus for playing a wagering card game as set forth in claim 27, including a playing surface; and a graphical representation of a count limit card disposed on the playing surface, the count limit card having a predetermined numerical count value, the representation thereof being assigned as one playing card of the dealer's hand.

30. A wagering card game comprising, in combination:

a deck of playing cards;

a playing surface;

a dealer station disposed on the playing surface for receiving and displaying a hand of cards dealt from the deck;

a player station disposed on the playing surface for receiving and displaying a hand of cards dealt from the deck;

a bonus hand card dock disposed on the playing surface for receiving and displaying a hand of cards dealt from the deck; and a bonus payout schedule including a set of bonus payout values, each payout value being indexed within the schedule by cross-reference to the count value of a predetermined player hand and the count value of a predetermined bonus hand.

* * * * *